US005952062A

United States Patent [19]

Clark et al.

[11] Patent Number: 5,952,062

[45] Date of Patent: Sep. 14, 1999

[54] LAMINATE WRAP

[75] Inventors: Richard Clark, Lebanon; Robin Neary, Warren, both of N.J.

[73] Assignee: Newark Group Industries, Inc., Cranford, N.J.

[21] Appl. No.: 08/858,051

[22] Filed: May 16, 1997

[51] Int. Cl.[6] ..... B65D 1/40

[52] U.S. Cl. ..... 428/12; 156/196; 156/256; 229/122.26; 428/542.8

[58] Field of Search ..... 428/12, 542.8; 229/122.26; 156/196, 256

[56] References Cited

U.S. PATENT DOCUMENTS 4,976,374 12/1990 Macaluso ..... 229/122.26

*Primary Examiner*—Henry F. Epstein

*Attorney, Agent, or Firm*—Stroock & Stroock & Lavan LLP

[57] ABSTRACT

A laminate wrap constructed in accordance with the invention is provided which is formed and shipped in a flat shape, and which may be converted into a rigid L, U or square/rectangular shipping or storage container for the protection of long articles during shipping and storage. The laminate wrap is constructed to allow for ease in formation and handling, but after formation into an L, U or other shaped shipping or storage container, to produce a rigid storage structure or tube.

19 Claims, 5 Drawing Sheets

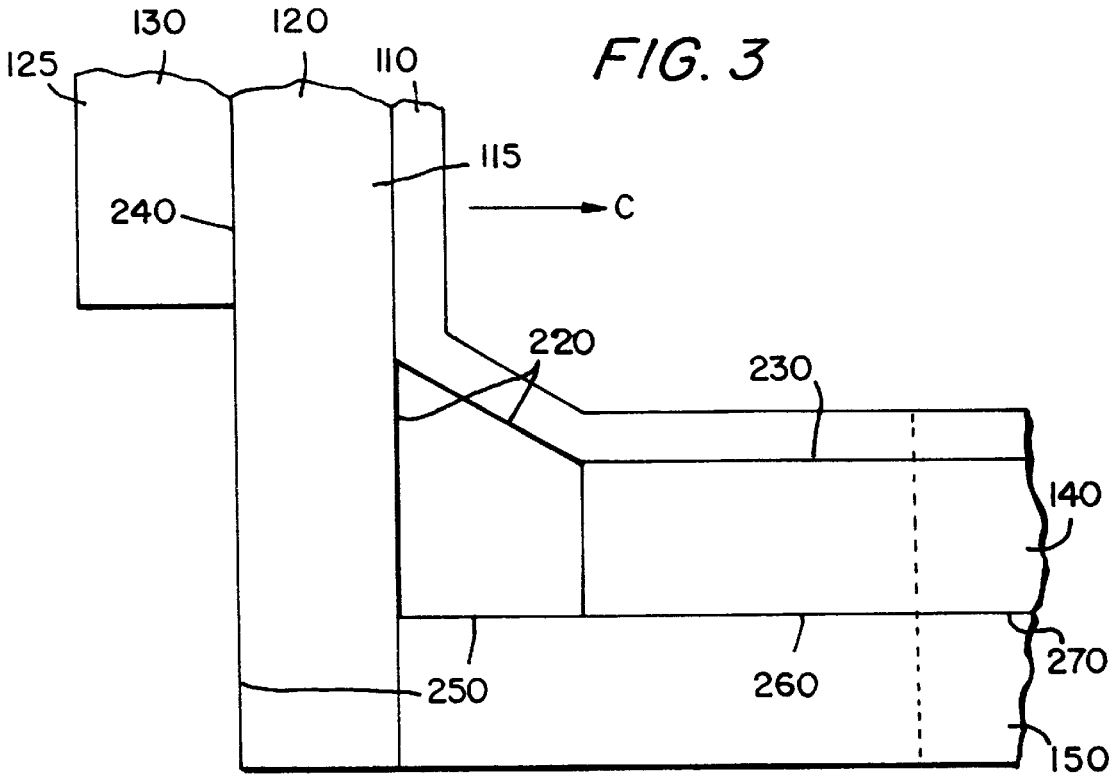
FIG. 3
FIG. 4
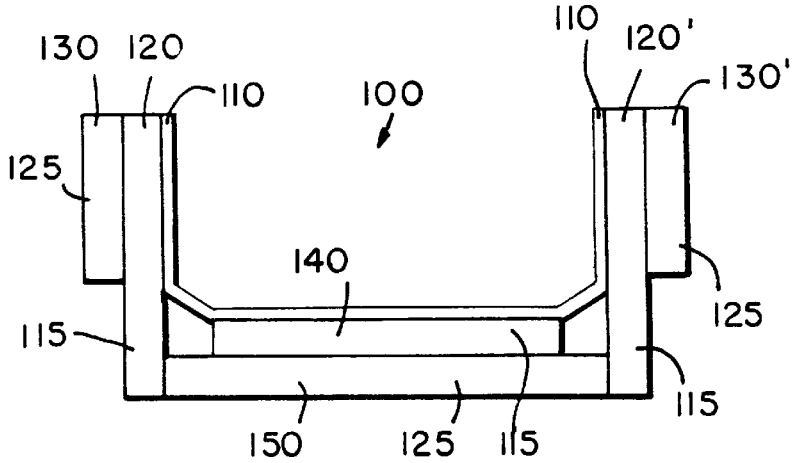

LAMINATE WRAP

This invention relates generally to a laminate wrap and more particularly to a laminate wrap for wrapping long articles, such as glass rods, pipes, venetian blinds and the like for shipping, storage or other activities requiring these articles to afforded more protection then commonly used corrugated packages.

In the prior art, typically a performed U-shaped angle board is used. The material is formed of a number of layers of paperboard 10*a*–10*n*, and is formed around a mold which gives the board its U-shaped appearance. Layer after layer of this paperboard is applied to a U-shaped mold. Thus, a U-shaped, rigid, multi-layer paperboard 11 is formed. Such a product is sold by REDDI-PAC™, INC., under the trademark REDDI CRATE® and is depicted in FIG. 7.

In order to pack any long object, a user utilizes two of U-shaped paperboard constructions 11 and telescopes them so as to form a rectangular tube 12. Such a nesting and formation of a tube is shown in FIG. 8. Thus, the outer structure of the container is therefore all formed of the rigid multi-layer paperboard. A rigid tube is produced which will protect the contents inside, regardless of their length since this U-shaped material can be formed in any length, and for that matter, can be formed in any size. However, the larger the U-shaped board, the less rigid the final package.

While this U-shaped board has been sufficient, it has a number of drawbacks. First, since each portion of the U-shaped material used to form a particular sized tube is the same size, pieces of the material will not nest easily within each other. Therefore, during storage, it is necessary to nest the boards as tubes 12, as shown in FIG. 8 to minimize the room needed to store the tubes. There is no more efficient manner in which to store this material. Therefore, this packing material takes up as much space empty as it does full. Since warehouse space and space on a shipping vessel is so expensive, the user of paperboard 11 is required to pay for this extra empty space during transport and storage of the materials. Therefore, it would be beneficial to provide a wrap for shipping long materials which could be shipped and stored in a manner which used up less space, and allowed the material to be stored more efficiently while still providing a rigid U-shaped shipping vessel to protect long items during shipping.

SUMMARY OF THE INVENTION

Generally speaking, in accordance with the invention, a laminate wrap is provided which is formed and shipped in a flat state, and then is convertible into a rigid corner or U-shaped shipping or storage container for the protection of long articles during shipping and storage. The laminate wrap is constructed to allow for ease in formation and handling, but after formation into a U-shaped or cornered shipping material, to produce a rigid shipping material.

In an embodiment of the invention, the laminate wrap is formed with a first layer having top and bottom opposed surfaces, a second layer having first and second opposed surfaces and a third layer having first and second opposed surfaces. The second layer is cut through along a cut line through the first layer forming a first second layer portion and a second second layer portion. The first surface of the second layer is fixed to the first layer. A portion of the first second layer portion is affixed a predetermined distance from the cut line. The third layer is cut through along a cut line through the third layer forming a first third layer portion and a second third layer portion. The first third layer portion is fixed to the second surface of the first second layer portion and the second third layer portion is affixed to the second second layer portion a predetermined distance from the third layer cut line. Thus, the second third layer portion may be restoratively deflected. The first second layer portion is moveable between a first position substantially parallel to the second third layer portion to a second position forming a corner with the second third layer portion. The first second layer portion deflects the second third layer portion when moving between the first position and second position.

During use, this structure forms a corner by bending the first and second edges of the top surface of the first layer towards each other, the cuts in the second and third layers allows these layers to separate from each other, and pass each other so that the portions of the top surface of the first layer on either side of the local midpoint form essentially a right angle to each other. Thus, the board will be locked into this right angle position. During formation, as the first layer is bent, the portion of the second layer which is not fixed to the first layer is separated therefrom, forming a crease in the first layer on each side of the non-fixed portion. This non-fixed portion of the second layer pushes on the top surface of the third layer. The portion of the third layer which is not connected to the second layer begins to separate from the second layer, allowing the portion of the second layer to continue its motion. After a predetermined amount of motion, the non-fixed portion of the second layer passes the cut in the third layer, and is fixed in a position perpendicular thereto, thereby forming a right angle and a corner of a storage material.

While the formation of a single corner has been described, thereby resulting in an L-shaped unit, the use of a mirror image structure to the one described above (or a non-mirror image structure) will result in the formation of an opposing corner, which when used together forms a U-shaped unit. Additionally, a third corner could be formed, thus resulting in a triangular, requiring only one corner to be taped shut, a fourth corner an be added to form a square or rectangular tube and so on.

Because the laminate wrap is formed in a flat structure, the process of formation of the laminate is greatly simplified. A first continuous layer, a second layer having a cut at a first position thereof and a third layer having a cut at a second position thereof are fixed together by gluing at specific, predetermined locations. After the cuts and glue have been formed and applied at the proper locations, as noted above, the three layer structure may be run through pressurized rollers to ensure proper contact and fixing between the layers. Then, the product is complete. No additional formation steps are required, since the flat structure with the cuts and glue in the proper predetermined locations is not formed into an L, U, or rectangular shape until the user is ready to use the product.

Accordingly, it is an object of the invention to provide an improved laminate wrap which overcomes the drawbacks of the prior art.

Another object of the invention is to provide a U-shaped shipping material which can be formed as a flat structure, but which can be transformed into a U-shaped structure immediately prior to use.

A further object of the invention is to provide a laminate wrap which is less expensive to store and ship while providing the structure and benefits of conventional U-shaped shipping boards.

Still other objects and advantages of the invention will in part be obvious and will in part be apparent from the specification and the drawings.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is an enlarged side elevational view of a portion of a paperboard structure constructed in accordance with the invention in a right angle position;

FIG. 4 is a side elevational view of a paperboard structure constructed in accordance with the invention forming a U-shape;

DETAILED DESCRIPTION OF THE PREFERRED EMBODIMENTS

Figure 1:
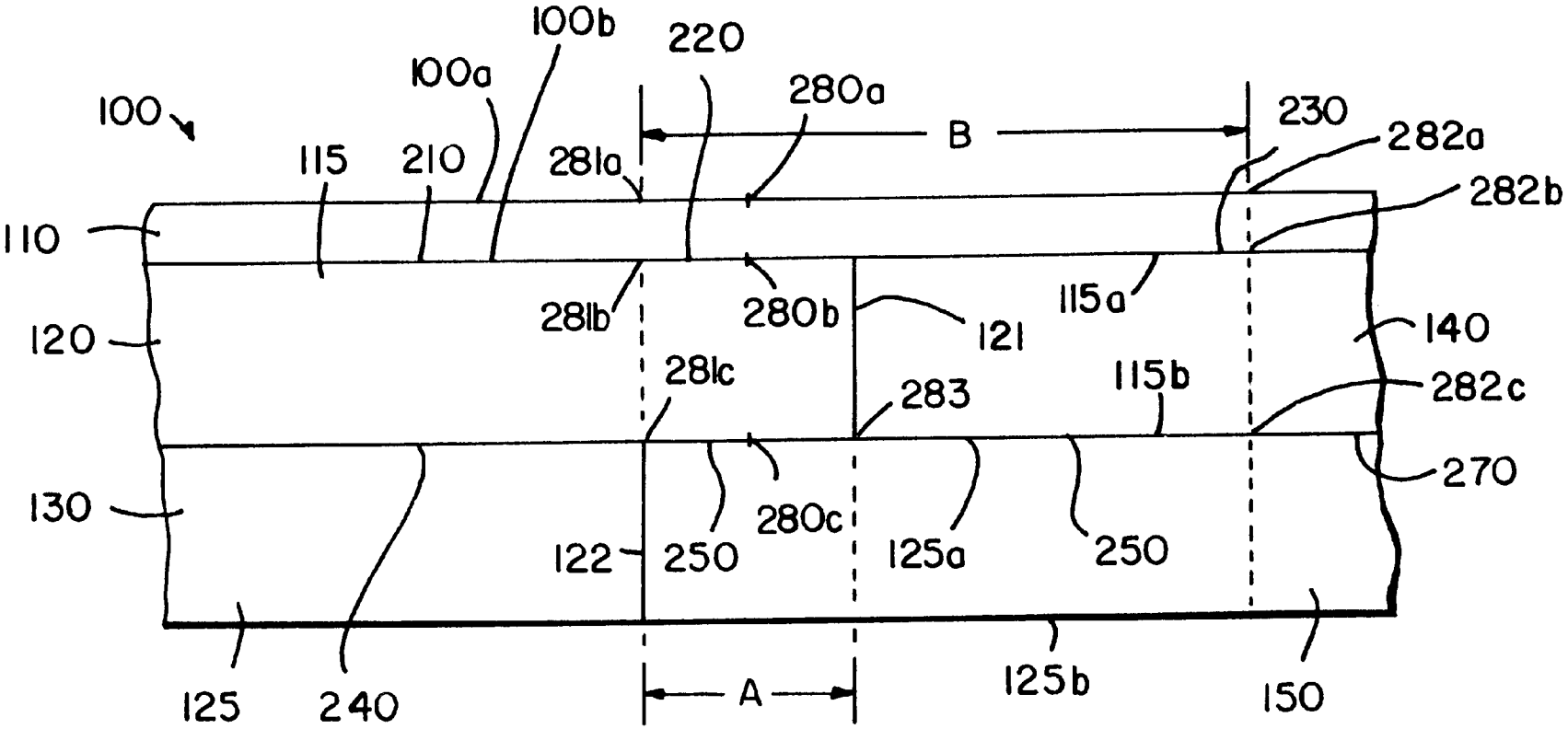
FIG. 1 is an enlarged side elevational view of a portion of a paperboard structure constructed in accordance with the invention in a flat position.

Referring first to FIGS. 1–4, a laminate paperboard structure capable of forming a protective wrapping, indicated generally as 100, is depicted as constructed in accordance with a first embodiment of the invention. While paperboard structure 100 is described as being formed out of a paperboard laminate material, it would be possible to construct this structure out of any number of resilient, but slightly flexible materials, such as plastics or other suitable material. Paperboard structure 100 may form an edge as shown in FIG. 3 or a U-shaped structure as shown in FIG. 4. Paperboard structure 100 necessary to form a U-shaped structure includes a first layer 110, a second layer 115, and a third layer 125. Second layer 115 is divided into a center portion 140, and left and right side portions, 120 and 120', respectively. Third layer 125 is divided into a center portion 150 and left and right side portions 130 and 130'.

As is shown in FIG. 1, paperboard structure 100 necessary for forming a single corner is formed of first layer 110, having first and second opposed surfaces 100*a* and 100*b*, a second layer 115 having first and second opposed surfaces 115*a* and 115*b*, and a third layer 125 having first and second opposed surfaces 125*a* and 125*b*. Second layer 115 includes left portion 120 and center portion 140 separated by a cut line 121. Third layer 125 includes a left portion 130 and center portion 150 separated by a cut line 122. The different portions of each layer of paperboard may be formed individually, or alternatively, each layer may be formed as a continuous layer, and then cut to form the portions of the layers as required. A respective reference point 280*a*, 280*b*, 280*c* (collectively reference point 280) is positioned in a line on each of the first, second and third layers. As is shown in FIG. 1, left portion 120 of second layer 115 extends a predetermined distance past reference point 280*b* in the direction of center portion 140 of second layer 115. Similarly, center portion 150 of third layer 125 extends a predetermined distance past reference point 280*c* towards left portion 130 of third layer 125. This extension of each layer in opposite directions past reference point 280 provides an overhang between these two layers.

As is also shown in FIG. 1, a distance A is measured as a predetermined distance positioned symmetrically about reference points 280. A second group of respective reference points 281*a*, 281*b*, 281*c*, are positioned ½ A from reference point A. A third group of respective reference points 282*a*, 282*b*, 282*c* (collectively 282) is positioned a predetermined distance B from reference points 281 on each respective layer a distance in a direction past reference points 280. Between first layer 110 and second layer 115 a first confronting surface 210 is formed beyond second reference point 281*b* in a direction away from third reference point 282*b*. A second confronting surface 220 between first layer 110 and second layer 115 is formed between cut line 121 and reference point 281*b*. A third confronting surface 230 between first layer 110 and second layer 125 is formed from cut line 121 and extends beyond third reference point 282*b*. Similarly, between second layer 115 and third layer 125, a fourth confronting surface 240 is formed along left portion 130 beyond second reference point 281*b* in a direction away from third reference point 282*b*. A fifth confronting surface 250 is formed between cut line 122 and reference point 282*c* (the length of distance B), and a sixth confronting surface 270 is formed between layers 115 and 125 and extends beyond third reference 282*c* away from cut line 122.

Second layer 115 is fixed to first layer 110 along first confronting surface 210 and third confronting surface 230. These layers are not fixed to each other along second confronting surface 220, above the overhang formed between second layer 115 and third layer 125. Similarly, third layer 125 is fixed to layer 115 along fourth confronting surface 240, and sixth confronting surface 270. These layers are not fixed to each other along fifth confronting surface 250 above the overhang formed between second layer 115 and third layer 125, and also beyond the overhang in the direction of center portion 140 of second layer 115 up to sixth confronting surface 270.

In a preferred embodiment, distance A is 7/16" and distance B is 1 and 5/16" when a paperboard structure is 6" wide. However, distances may vary, as long as distance B is selected to be greater than distance A, shares a common boundary with distance A, and extends beyond distance A in the same direction in which the longer portion (120 in FIG. 1) of second layer 115 (adjacent reference point 280) extends beyond reference point 280.

Figure 2:
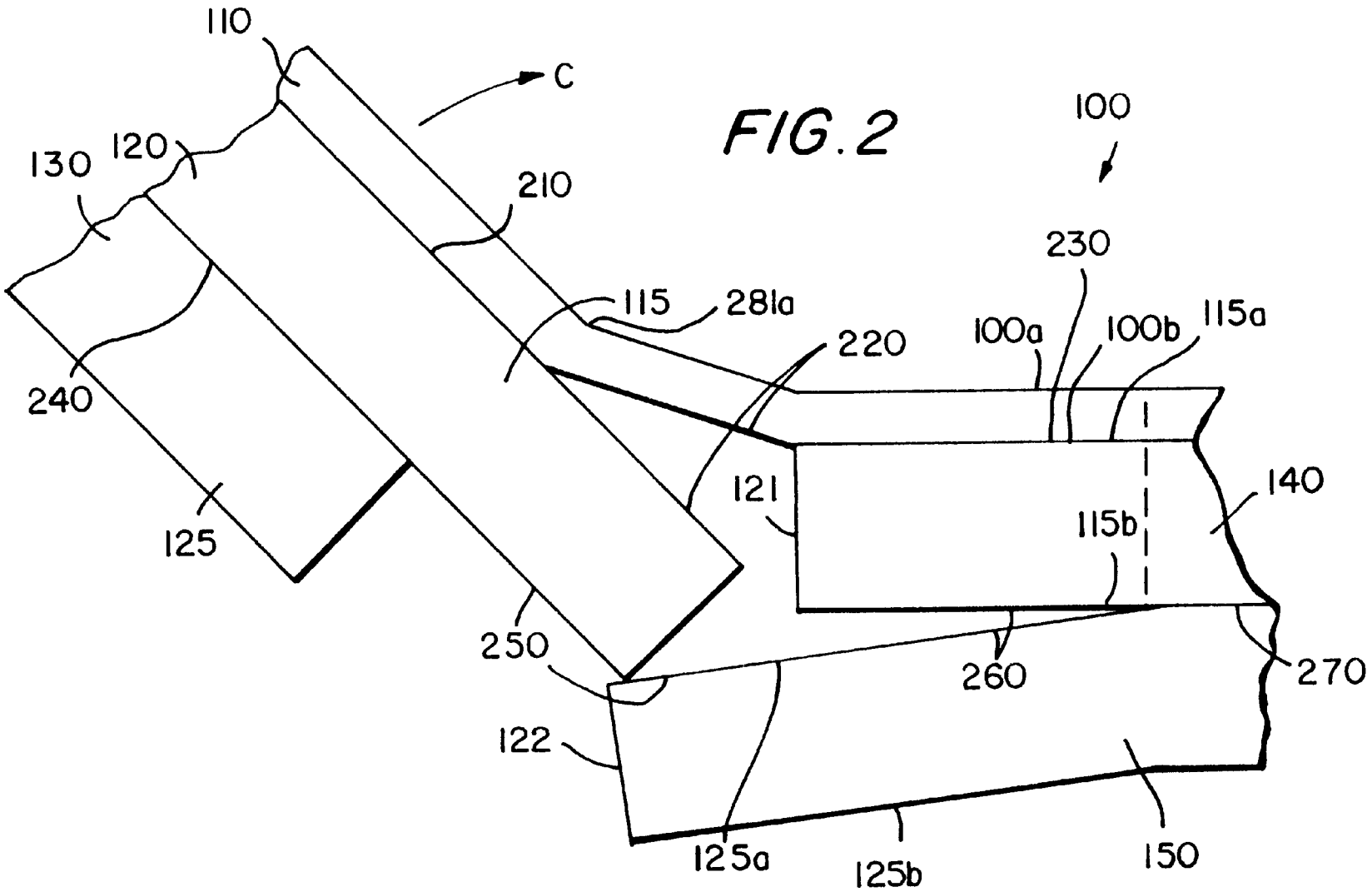
FIG. 2 is an enlarged side elevational view of a portion of a paperboard structure constructed in accordance with the invention in a transition position between a flat position and a right angle position.

Reference is next made specifically to FIG. 2 which depicts the construction of FIG. 1 after the folding of a corner has begun. As the left portion of paperboard 100 is moved upwards in the direction of Arrow C, the portions of first layer 110 and the left portion 120 of second layer 115 adjacent confronting surface 220 begin to separate. Creases naturally begin to form in first layer 110 substantially adjacent reference point 281*a* and cut line 121, since first and second layers 110 and 115 are not fixed to each other adjacent second confronting surface 220.

As the left portion of paperboard 100 is further moved in the direction of Arrow C, left portion 120 of second layer 115 deflects center portion 150 of third layer 125 separating the layers along fifth confronting surface 250. This deflection results in left portion 120 of second layer 115 exerting a force against center portion 150 of third layer 125 along fifth confronting surface 250. Center portion 150 of third layer 125 is deflected and separates center portion 140 along a surface portion 260 of confronting surface 250 since these layers are not fixed to each other along surface portion 260. This separation allows left portion 120 of second layer 115 to continue its motion without breaking as the left portion of first layer 110 is moved upward. Second and third layers 115 and 125 do not separate along fourth and sixth confronting surfaces 240 and 270, since these layers are fixed to each other along these confronting surfaces.

Reference is next also made to FIG. 3 which depicts the final position of paperboard 100 after the movement of the left portion of first layer 110 has been completed. As the left portion of paperboard 100 is moved further in the direction of Arrow C, left portion 120 of second layer 115 slides along fifth confronting surface 250 and disengages from fifth confronting surface 250 and moves past center portion 150 of third layer 125. At this time, because of the relative lengths of left portion 120 of second layer 115 and center portion 150 of third layer 125, when left portion 120 clears center portion 150, the resiliency of paper center portion 150 carries surface portion 260 to return to a confronting position with central portion 140, so that center portion 150 abuts left portion 120, thereby locking the portions into the relative positions shown in FIG. 3.

It is also possible to undue the corner structure and return paperboard 100 back to a flat structure by moving the left portion of first layer 110 and the left portions 120 and 130 of second and third layers 115 and 125 so that the edge of left portion 120 of second layer 115 moves above confronting portion 250. Then, if the left portion of first layer 110 is moved downward, in the direction opposite to the movement previously provided during the movement in FIG. 2, all of the opposite motions will take place, and paperboard 100 will once again be flat.

Thus, it is possible to provide a paperboard with one such corner structure so that the paperboard may be transformed between a flat structure and an L-shaped structure. Alternatively, as is shown in FIG. 4, if mirror image corner structures are provided, the paperboard may be transformed between a flat structure, an L-shaped structure (by only activating one of the corner structures) and a U-shaped structure (by activating both of the corner structures). As is shown in FIG. 4, in this embodiment left and right side portions 120 and 120' of second layer 115 extend past, and engage center portion 150 of third layer 125. Thus, because of this engagement, U-shaped paperboard structure 100 is maintained in its U shape. The terms left and right are used in this description for the ease in describing relative positioning of parts. These directions are not meant to limit the actual positioning of any portion of the invention. Any direction or relative positions are possible. As noted above, it would also be possible to provide a third corner structure, which when all three corner structures were engaged, a rectangular tube would be formed requiring only one corner to be fastened shut.

Figure 8:
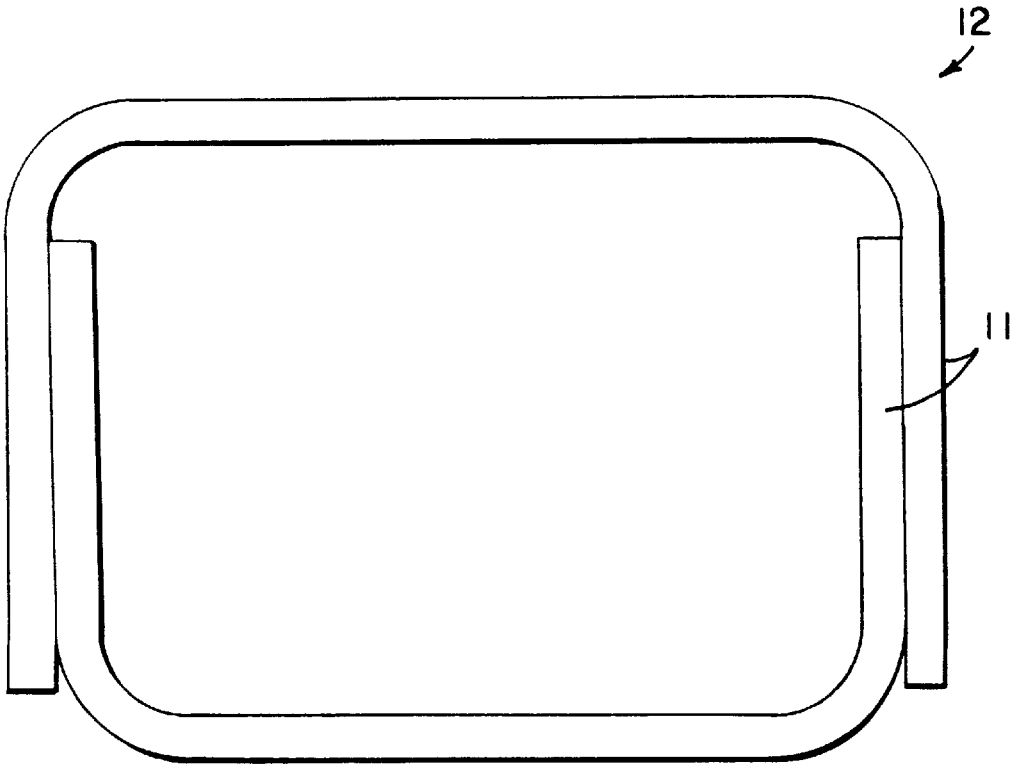
FIG. 8 PRIOR ART
FIG. 8 is a side elevation view of two prior art U-shaped paperboard containers, nested in a manner common in the prior art.

In the standard structure, when a U-shaped structure is formed using two corner structures, to form a rectangular tube for shipping or storage, as in the prior art, two U-shaped structures are fitted together (as shown in FIG. 8), and are fastened in this position. Thus a rectangular tube would be formed.

Figure 5:
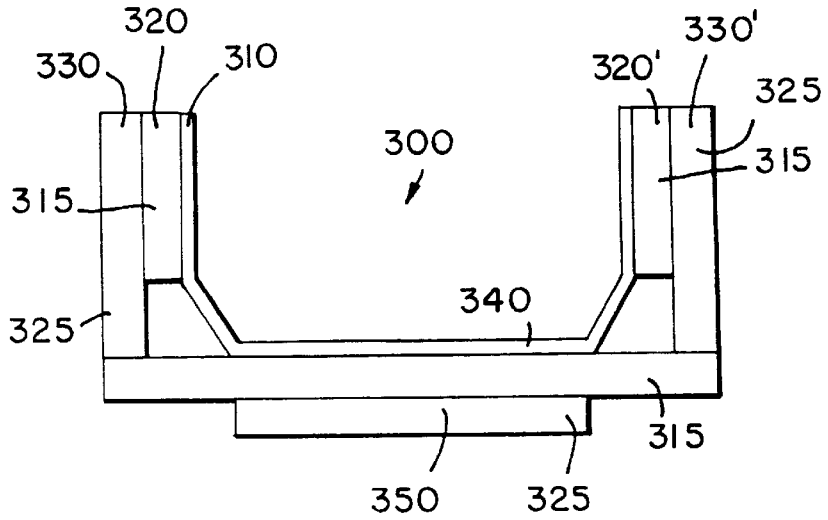
FIG. 5 is a side elevational view of a paperboard structure constructed in accordance with a second embodiment of the invention positioned in a U-shape using corner structures.

Additionally, as is shown in FIG. 5, it would be possible to reverse the direction of the cuts in the second and third layers, thereby forming a U-shaped structure in which a center portion 340 of a second layer 315 extends beyond the cut lines separating left portion 330 and a right portion 330' of a third layer 325 from center portion 350 of third layer 325. All other dimensions and functions would work identically to the structure and procedure explained with reference to FIGS. 1–4, reference numerals with similar last two digits of reference numerals define similar structure. Therefore, first layer 310 is formed similarly to first layer 110. Second layer 315 with left, center and right portions 320, 340 and 320', respectively, is formed similarly to second layer 115, and left, center and right portions 120, 140 and 120', respectively. Finally, third layer 325 with left, center and right portions 330, 350 and 330', respectively is formed similarly to third layer 125, with left, center and right portions 130, 150 and 130' respectively. The difference between the structure in FIG. 4 and the structure depicted in FIG. 5 is the positioning of the cuts in the second and third layers and the gluing portion between all of the layers. The relative lengths and positioning of cut lines and fixed areas between the second and third layers is transposed, i.e. a mirror image of laminate 100.

In other words, if cut line 121 in second layer 115 were positioned at reference point 281*b*, and thus left portion 120 would extend only to second reference point 281*b*, and center portion 140 would also extend to second reference point 281*b*, and therefore, center portion 340 would form an overhang past reference point 280. Additionally, if cut line 122 in third layer 125 were positioned point 283 a distance from reference point 281*c* in the direction of reference point 282*c* and thus, left portion 125 would extend to reference point 283, and center portion would also extend only to reference point 283, thus forming the lower portion of the overhang. Thus, the mirror image of the entire construction of the structure depicted in FIG. 1 would result. Furthermore, the relative motion of the parts of the structure would be opposite to that shown in FIG. 1. Thus, during movement, center portion 340 of second layer 315 would be forced against left portion 330 of second layer 325. Left portion 330 would deflect from left portion 320 of second layer 315, thus allowing center portion 340 to pass therethrough, and resulting in being positioned as shown as the left corner in FIG. 5. Alternatively, if one rotates FIG. 3 90° counterclockwise, it will be apparent that this structure now resembles that of the right corner structure utilized in FIG. 5. Thus, based upon the relative positioning of the different layers and cuts therein, different corner structures can be provided.

Thus, in accordance with the invention, a rigid U-shaped structure is provided which is strong and may be formed into rectangular tubes for shipping or storing long objects, yet which may be shipped and stored in a flat manner is provided.

Figure 6:
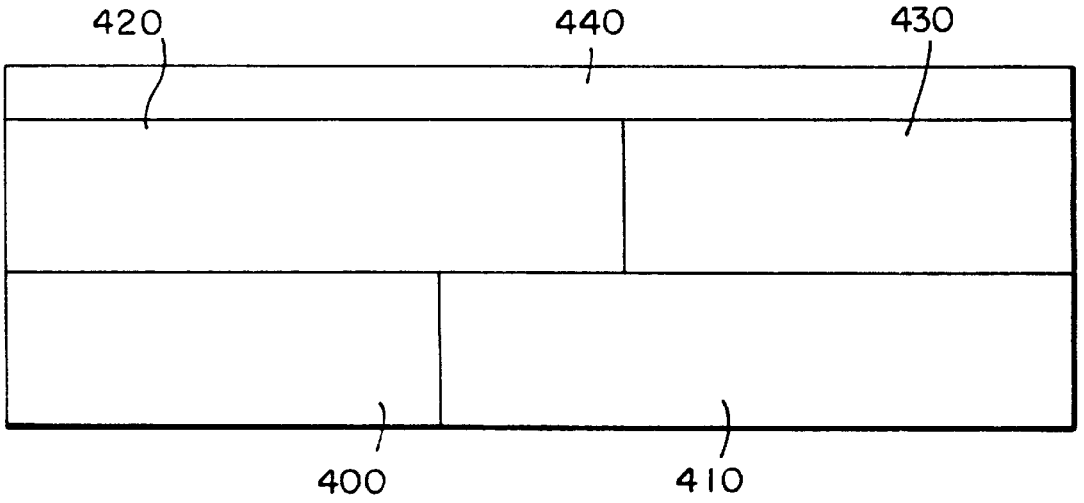
FIG. 6 is an enlarged side elevational view of a complete paperboard structure constructed in accordance with the second embodiment of the invention.
Figure 7:
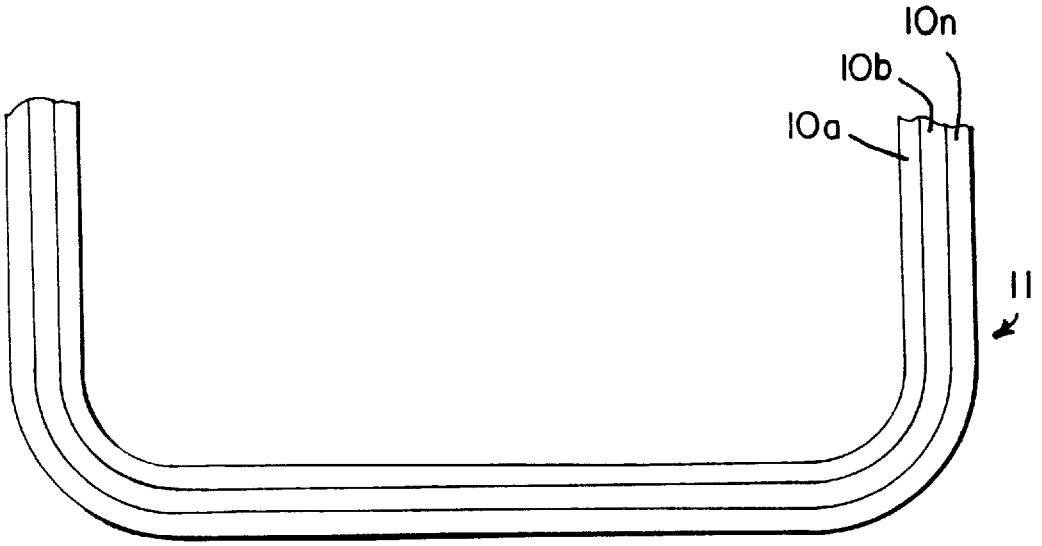
FIG. 7 PRIOR ART
FIG. 7 is a side elevational view of a U-shaped paperboard container constructed in accordance with the prior art.

Additionally, as noted above, paperboard 100 can be produced using an improved method. Indeed, the formation of this paperboard structure requires only a single piece of paperboard cut to any length as required by the user. Then, three cuts along the length of the paperboard are required, each cut extending across the complete width of the paperboard. As is shown in FIG. 6, in a preferred embodiment to form first and second pieces of paperboard 400 and 410 of the same length, and third and fourth pieces of paperboard 420 and 430 of different lengths, but the sum of whose lengths equal the sum of the length of the first and second pieces. Additionally, the difference between the lengths of the third and fourth pieces should equal twice the length of distance A, noted above. First layer 440 is not formed with any cuts therein.

Thus, in a preferred embodiment, which is depicted in FIG. 6, first and second paperboard pieces 400 and 410 are positioned edge to edge in a 6" wide paper board, and are each 3". Third and fourth paperboard pieces are positioned on top of first and second pieces 400 and 410. The lengths of third and fourth pieces 420 and 430 in a 6" wide paperboard are 3 7/16" and 2 9/16" respectively. First layer 440 is formed 6" wide in 6" width paperboard, and has no cuts formed therein. Thus, through cutting a single paperboard piece, and applying a thin top layer, a structure similar to FIG. 1 can be formed. If the gluing and measurements described with respect to FIG. 1 are followed, a flat to L-shaped 6" wide paperboard can be formed. After applying glue in the proper places, the pieces may be forced together by applying pressure, such as by forcing the pieces through a pair of opposed, pressurized rollers. Various measurements may be employed, in order to form paperboard of different sizes, as long as the relative positioning of the pieces as set forth with respect to the discussion of FIG. 1 are followed.

Therefore, a laminate wrap constructed in accordance with the invention provides a laminate which is formed and shipped in a flat state, and which may be converted into a rigid L, U or square/rectangular shipping or storage container for the protection of long articles during shipping and storage. The laminate wrap is constructed to allow for ease in formation and handling, but after formation into and L, U or other shaped shipping or storage material, to produce a rigid U-shaped shipping or storage material.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed:

1. A laminate wrap for forming a corner, comprising:

a first layer having top and bottom opposed surfaces;

a second layer having first and second opposed surfaces, said second layer being cut through along a cut line through said second layer forming a first second layer portion and a second second layer portion, said first surface of said second layer being fixed to said first layer, a portion of said first second layer portion being affixed to said first layer a predetermined distance from said cut line; and a third layer having first and second opposed surfaces, said third layer being cut through along a cut line through said third layer forming a first third layer portion and a second third layer portion, said first third layer portion being fixed to said second surface of said first second layer portion and said second third layer portion being affixed to said second second layer portion a predetermined distance from said third layer cut line permitting said second third layer portion to be restoratively deflected, said first second layer portion being moveable between a first position substantially parallel to said second third layer portion to a second position forming a corner between said second third layer portion and said first second layer portion, said first second layer portion deflecting said second third layer portion when moving between said first position and second position.

2. The laminate wrap of claim 1, wherein said first, second and third layers are formed of paper board.

3. The laminate wrap of claim 1, wherein said first, second and third layers are formed of a resilient plastic.

4. The laminate wrap of claim 1, wherein said first, second and third layers are formed of a resilient material.

5. The laminate wrap of claim 1, wherein said layers are fixed by glue.

6. The laminate wrap of claim 1, wherein said first corner is maintained with a 90° angle after bending.

7. The laminate wrap of claim 1, further comprising a second corner structured as a mirror image of said first corner.

8. The laminate wrap of claim 7, wherein said first and second corners are each maintained with a 90° angle after bending, thus forming a U-shaped rigid structure.

9. The laminate wrap of claim 8, wherein two U-shaped rigid structures are positioned opposing each other and are interlaced to form a square or rectangular tube.

10. The laminate wrap of claim 1, futher comprising second and third corners structured similarly to said first corner.

11. The laminate wrap of claim 10, wherein a triangular structure is formed.

12. The laminate wrap of claim 10, wherein a rectangular structure is formed.

13. The laminate wrap of claim 1, further comprising second, third and fourth corners structured similarly to said first corner.

14. The laminate wrap of claim 13, wherein a rectangular structure is formed.

15. The laminate wrap of claim 1, wherein said laminate wrap may be efficiently shaped or stored in its flat configuration.

16. A method of forming an L-shaped paperboard structure from a flat paper board structure, said flat paperboard structure comprising:

a first layer having top and bottom opposed surfaces;

a second layer having first and second opposed surfaces, said second layer being cut through along a cut line through said second layer forming a first second layer portion and a second second layer portion, said first surface of said second layer being fixed to said first layer, a portion of said first second layer portion being affixed to said first layer a predetermined distance from said cut line; and a third layer having first and second opposed surfaces, said third layer being cut through along a cut line through said third layer forming a first third layer portion and a second third layer portion, said first third layer portion being fixed to said second surface of said first second layer portion and said second third layer portion being affixed to said second second layer portion a predetermined distance from said third layer cut line permitting said second third layer portion to be restoratively deflected, said first second layer portion being moveable between a first position substantially parallel to said second third layer portion to a second position forming a corner between said second third layer portion and said first second layer portion, said first second layer portion deflecting said second third layer portion when moving between said first position and second position;

the method comprising the steps of:

moving said first surface of said first layer adjacent said first second layer portion towards said first surface of said first layer adjacent said second second layer portion;

urging said first second layer portion relative to said second third layer portion; and releasing said first second layer portion from said second third layer portion, said second third layer portion being deflected away from said first and second layer portions by said first second layer portion to allow for the movement of said first second layer portion relative to said second third layer portion, whereby said first second layer portion is positioned essentially perpendicularly to said portion of said second third layer portion, thereby forming an L-shaped member.

17. The method of claim 16, wherein said method is performed on a second mirror image structure so as to form a first U-shaped member.

18. The method of claim 17, further comprising the steps of:

forming a second U-shaped member;

positioning said first and second U-shaped members opposing each other;

interlacing said first and second U-shaped members so as to form a square or rectangular tube.

19. The method of claim 16, further comprising the steps of:

moving said first surface of said first layer adjacent said first second layer portion in a direction perpendicular to said first surface of said first layer adjacent said second second layer portion; and releasing said first second layer portion past said second third layer portion whereby said paper board is returned to its flat state.

* * * * *